US005461739A

United States Patent [19]

Falbo, Sr.

[11] Patent Number: 5,461,739

[45] Date of Patent: Oct. 31, 1995

[54] PATIENT MIDSECTION AND SHOULDER SUPPORT APPARATUS FOR TILTING EXAMINATION TABLE

[75] Inventor: Michael G. Falbo, Sr., Gladstone, Mo.

[73] Assignee: American Echo, Inc., Kansas City, Mo.

[21] Appl. No.: 280,223

[22] Filed: Jul. 25, 1994

[51] Int. Cl.[6] ..... A61G 7/008; A61G 7/05; A61G 7/07

[52] U.S. Cl. ..... 5/607; 5/621; 5/623; 128/870; 128/876; 482/57; 482/142

[58] Field of Search ..... 5/607, 601, 608, 5/609, 621, 623, 424; 482/142, 57; 128/870, 871, 876

[56] References Cited

U.S. PATENT DOCUMENTS

| | | | |
|---|---|---|---|
| 225,455 | 3/1880 | Adams . | |
| 395,001 | 12/1888 | Russell . | |
| 1,040,795 | 10/1912 | Skeffington . | |
| 1,115,794 | 11/1914 | Eriksen | 5/621 |
| 1,274,851 | 8/1918 | Byrd . | |
| 1,891,599 | 12/1932 | Kushner . | |
| 2,103,693 | 12/1937 | Pohl . | |
| 2,897,029 | 7/1959 | Maisel | 5/607 |
| 3,200,416 | 8/1965 | Warrick | 5/608 |
| 3,265,432 | 8/1966 | Tabbert . | |
| 3,434,165 | 3/1969 | Keane | 5/609 |
| 3,652,851 | 3/1972 | Zaalberg . | |
| 3,795,018 | 3/1974 | Broaded . | |
| 3,973,126 | 8/1976 | Redington et al. . | |
| 4,285,515 | 8/1981 | Gezari | 482/57 |
| 4,506,664 | 3/1985 | Brault | 128/70 |
| 4,578,833 | 4/1986 | Vrzalik | 5/607 |
| 4,620,333 | 11/1986 | Ritter . | |
| 4,738,445 | 4/1988 | Lautenschläger | 482/142 |
| 4,939,801 | 7/1990 | Schaal et al. | 5/607 |
| 4,973,034 | 11/1990 | Michele . | |
| 5,040,546 | 8/1991 | Deluhery | 128/870 |
| 5,184,363 | 2/1993 | Falbo, Sr. | 5/601 |
| 5,299,334 | 4/1994 | Gonzalez | 5/623 |
| 5,390,383 | 2/1995 | Carn | 5/621 |

FOREIGN PATENT DOCUMENTS 379055 8/1964 Switzerland .

OTHER PUBLICATIONS

Echo Bed Specifications and Ordering Information, American Echo, Inc—1 page.

Echo Table Specifications and Ordering Information, American Echo, Inc.—1 page.

*Primary Examiner*—Alexander Grosz

*Attorney, Agent, or Firm*—Hovey, Williams, Timmons & Collins

[57] ABSTRACT

A patient-supporting bed especially adapted for cardiac sonography includes a horizontal uppermost bed surface, an exercise apparatus coupled to one end of the bed, a tilting mechanism for tilting the bed surface, and a novel support structure for supporting the patient on the tilted bed. The support structure includes a flexible patient support sling adapted to circumferentially surround the patient's midsection and an adjustable shoulder support apparatus adapted to engage one side of the patient's body while the bed is tilted. The bed surface includes an access opening and a corresponding shiftable bed filler sections disposed within the opening. The bed filler section is shiftable between upper and lower positions and include a latching assembly serving to normally maintain the filler section in an upper, generally horizontal position so that the bed presents a generally horizontal and uninterrupted patient-supporting top surface.

5 Claims, 3 Drawing Sheets

PATIENT MIDSECTION AND SHOULDER SUPPORT APPARATUS FOR TILTING EXAMINATION TABLE

BACKGROUND OF THE INVENTION

1. Field of the Invention

The present invention is broadly concerned with an improved patient-supporting bed that facilitates various diagnoses, and particularly echocardiography scans, upon a person lying upon the bed. More particularly, it is concerned with such a diagnostic bed that includes a horizontal uppermost bed surface, an exercise apparatus coupled to one end of the bed, a tilting mechanism for tilting the bed surface, and a novel patient support apparatus for securely supporting the patient on the tilted bed.

2. Description of the Prior Art

Diagnosis of cardiac irregularities often involves a treadmill test, wherein a patient exercises on a treadmill in order to increase his or her heartbeat to an elevated rate where an abnormality may be detected. Experience has proved that treadmill (exercise EKG) testing alone will not give an accurate diagnosis for a relatively large number of patients, i.e., even though the heart rate is elevated, an extant problem will not be detected. This is particularly the case with female patients.

As a consequence, it has become a common practice to perform cardiac sonography (also known as an echocardiography scan) on a patient immediately after a treadmill test is completed and while the patient's heart rate is still elevated. This combined diagnostic technique has proven to be very successful in correctly ascertaining the true condition of the patient's heart. However, to obtain optimum test results, it is necessary that two conditions be met. First, the cardiac sonography must be completed immediately after the treadmill test is concluded. Every second is important because the heart fully recovers from the effects of exercise in about two minutes. Second, the patient should be examined while either lying on the left side (left lateral) or while the bed is tilted downward to the left so that the patient's left side is tilted downward. The leftward tilting of the patient or the bed causes the patient's heart to shift leftward in the chest cavity. This allows the sonography probes to obtain more sensitive and accurate results.

To best meet these two conditions, it is advantageous to provide a patient-supporting bed which includes an exercise apparatus coupled to the bed and a tilting mechanism to tilt the bed so that the patient's left side is lowered relative to the rest of the body. In this way, the patient can exercise on the attached exercise apparatus and can be subsequently immediately examined. Since the bed can be tilted to shift the patient, the patient can be placed in the optimum position while exercising, thus eliminating the time needed to position the patient after exercise. Preferred patient-supporting beds include a drop-out access door or section in the bed adjacent the heart region which can be lowered to provide an access opening allowing the sonographer to place the sonography probe(s) at the various positions required for the diagnosis.

Use of diagnostic beds of this type presents a significant problem. In particular, the patient tends to slide off the bed while it is being tilted, resulting in injury or discomfort to the patient. One prior art solution to this problem is to provide the bed with standard seat belt type securement devices. These seat belts are attached to the sides of the bed and wrap around the top of the patient's stomach. Although standard seat belts prevent the patient from falling completely off the bed, they fail to prevent the patient from sliding on the surface of the bed. As a result, the patient slides to the left edge of the tilted bed and becomes uncomfortably wedged between the seat belt and the edge of the bed. Moreover, standard seat belts are awkward to use and pinch the patient's stomach.

There is accordingly a real and unsatisfied need for an improved diagnostic bed especially adapted to overcome the problems of prior beds of this character in the context of cardiac sonography examinations.

SUMMARY OF THE INVENTION

The present invention overcomes the difficulties outlined above, and provides an improved diagnostic patient support bed that facilitates effective sonographic testing while also supporting the patient on the bed in a secure and comfortable fashion.

The preferred patient support bed is especially adapted for cardiac sonography and broadly includes a horizontal uppermost bed surface, an exercise apparatus coupled to one end of the bed, a tilting mechanism for tilting the bed surface, and a novel support structure for supporting the patient on the tilted bed.

The bed surface includes at least one access opening and corresponding shiftable bed filler section disposed within the opening. The opening is located and sized for permitting sonographic diagnosis of a patient lying on the bed. A second opening may be provided and sized for accommodating the legs or other aspect of a person performing the diagnosis. The bed filler sections are shiftable between upper and lower positions and include latching assemblies serving to normally maintain each of the sections in an upper, generally horizontal position so that the bed presents a generally horizontal and uninterrupted patient-supporting top surface.

The preferred patient support structure broadly includes a flexible support sling adapted to circumferentially surround the patient's midsection and an adjustable shoulder support apparatus adapted to engage one side of the patient's body while the bed is tilted.

The present invention provides numerous advantages. First, the arrangement of the bed allows the cardiac sonography to be completed either during or immediately after the exercise test is concluded. Second, the bed allows the patient to be examined while the bed is tilted, thus optimally positioning the heart within the chest cavity so that the sonography probes can obtain more sensitive and accurate results. Third, the patient-supporting apparatus supports the patient on the bed in a secure and comfortable fashion while the bed is tilted without pinching the patient.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

Figure 1:
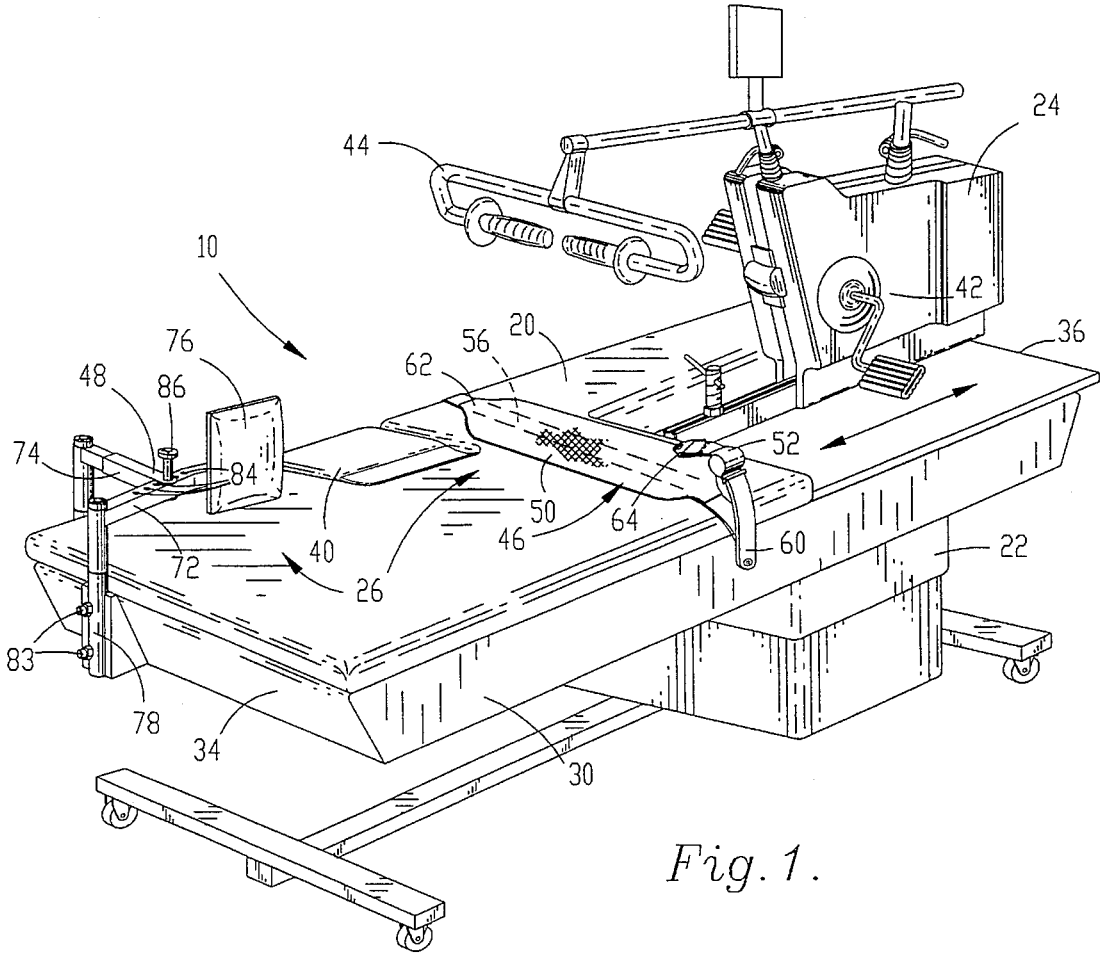
FIG. 1 is an isometric view of the diagnostic patient support bed in accordance with the invention.

Turning now to the drawings, and particularly FIG. 1, a patient-supporting diagnostic bed 10 is illustrated. Patient-supporting bed 10 is especially adapted for cardiac sonography and broadly includes a horizontal uppermost bed surface 20, a tilting mechanism 22 for tilting bed surface 20, an exercise apparatus 24 coupled to one end of bed 10, and a novel support structure 26 for supporting the patient on the tilted bed. In more detail, bed surface 20 presents a generally horizontal patient-supporting surface and includes a framework presenting elongated, side rails 30, 32, and end rails 34, 36. A mattress 38 or similar covering is situated atop bed surface 20.

Figure 2:
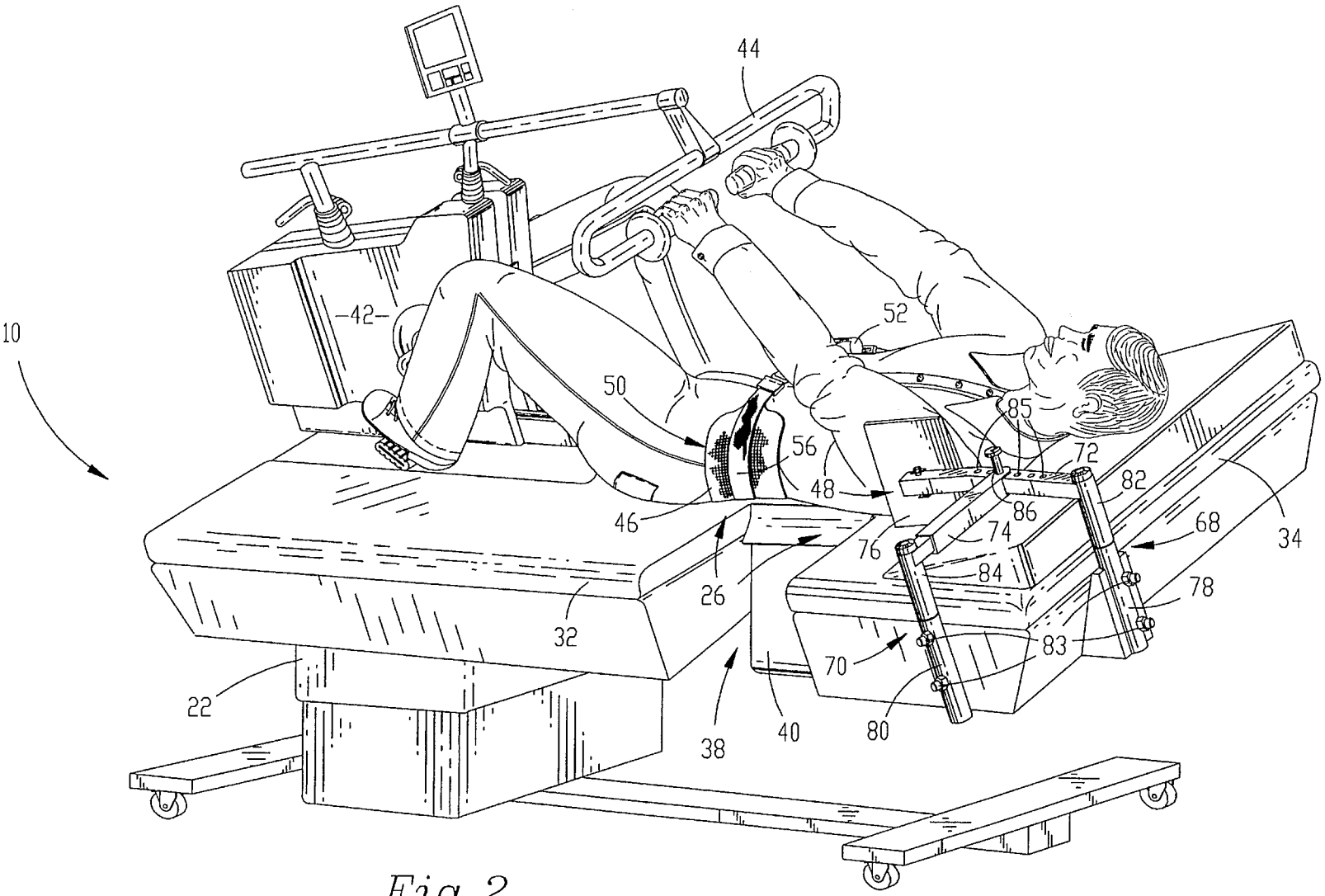
FIG. 2 is a side isometric view of the patient support bed illustrating the positioning of a patient thereon while the bed is tilted.
Figure 4:
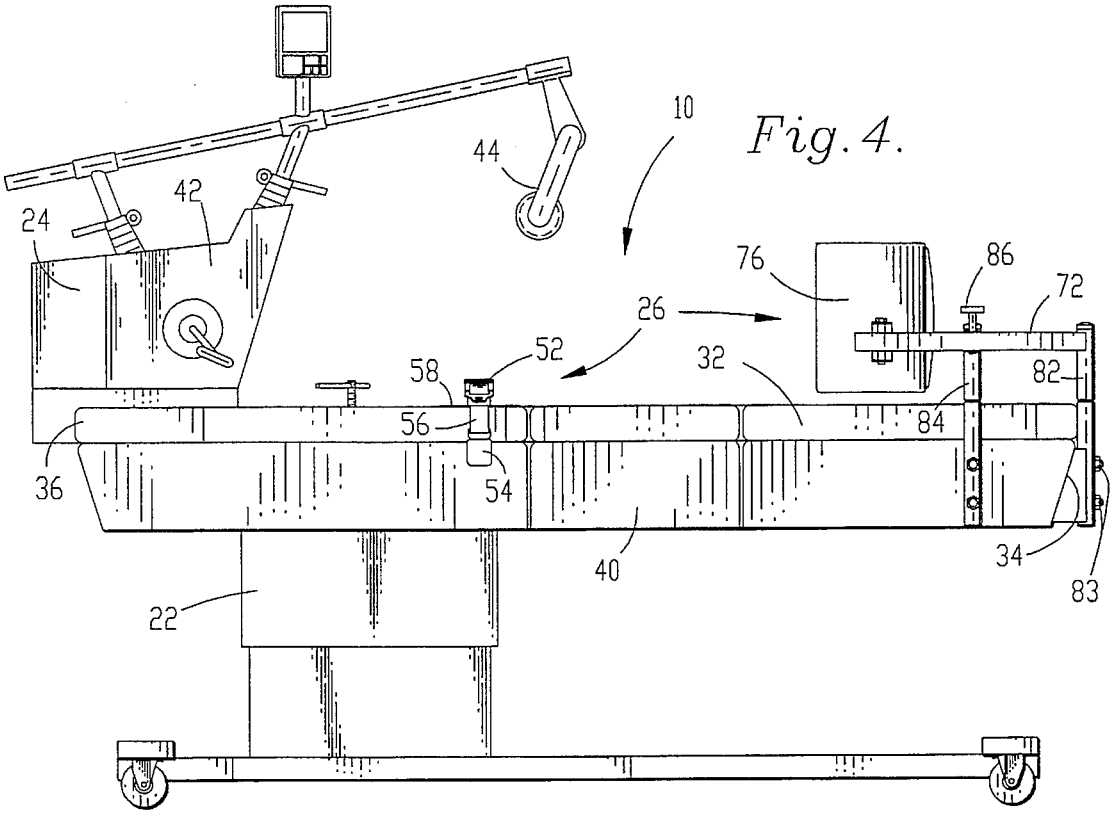
FIG. 4 is a left side elevational view of the patient support bed.
Figure 5:
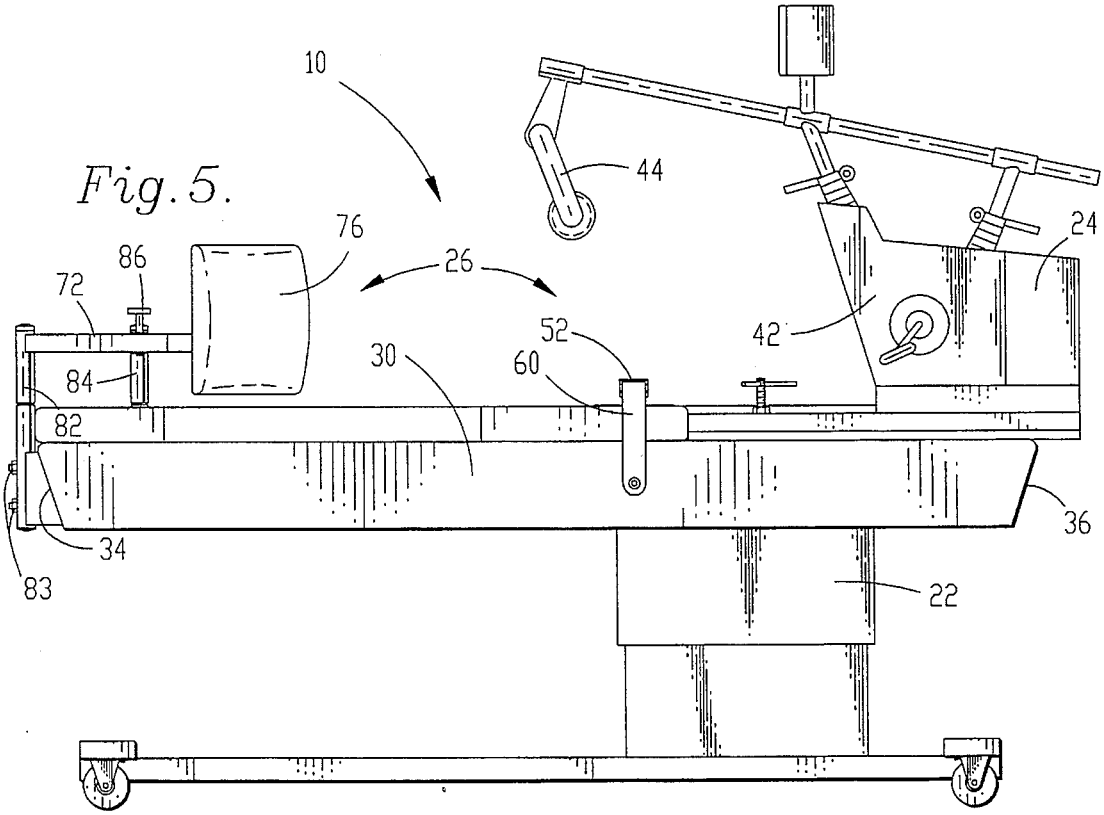
FIG. 5 is a right side elevational view of the patient support bed.

As illustrated in FIG. 2, bed surface 20 includes an access opening 38 and corresponding shiftable bed filler section 40 disposed within the opening. Opening 38 is located and sized for permitting sonographic diagnosis of a patient lying on the bed. A second opening may be provided and sized for accommodating the legs or other aspect of a person performing the diagnosis.

Bed filler section 40 is in the form of a generally L-shaped body and is sized to essentially fill opening 38. Bed filler section 40 is shiftable between upper and lower positions and includes a latching assembly serving to normally maintain the sections in an upper, generally horizontal position. Bed filler section 40 is pivotally secured to bed surface 20 by means of a hinge assembly (not shown).

In the use of bed 20, bed filler section 40 is normally placed in its uppermost position, so that the bed presents a substantially uninterrupted patient-supporting area along the length thereof. During testing, bed filler section 40 is shifted to its lower position so that the sonographer can more easily access the side of the patient's chest cavity. After the sonographic examination is completed, bed filler section 40 is lifted back to its respective horizontal position.

Tilting mechanism 22 is a conventional motorized tilting unit configured for tilting bed surface 20. Tilting mechanism 22 is coupled to the frame of bed 10 and is operable to tilt bed surface 20 to the left so that the patient's left side is lowered relative to the rest of the body. The leftward tilting of the patient is advantageous because it causes the patient's heart to shift leftward in the chest cavity. This allows the sonography probes to obtain more sensitive and accurate results. As those skilled in the art will appreciate, tilting mechanism 22 can be configured to tilt bed surface 20 in any orientation.

Exercise apparatus 24 is a conventional cycle-type exerciser used in sonographic and other exercise-type testing. As illustrated in FIG. 1, exercise apparatus 24 is coupled to the rear end of bed 10. The preferred exercise apparatus 24 includes a pedal exerciser section 42 and a handle bar section 44. In use, the patient lies on his or her back on bed surface 20, grips handle bar section 44, and operates pedal exerciser section 42 with his or her feet and legs.

Figure 3:
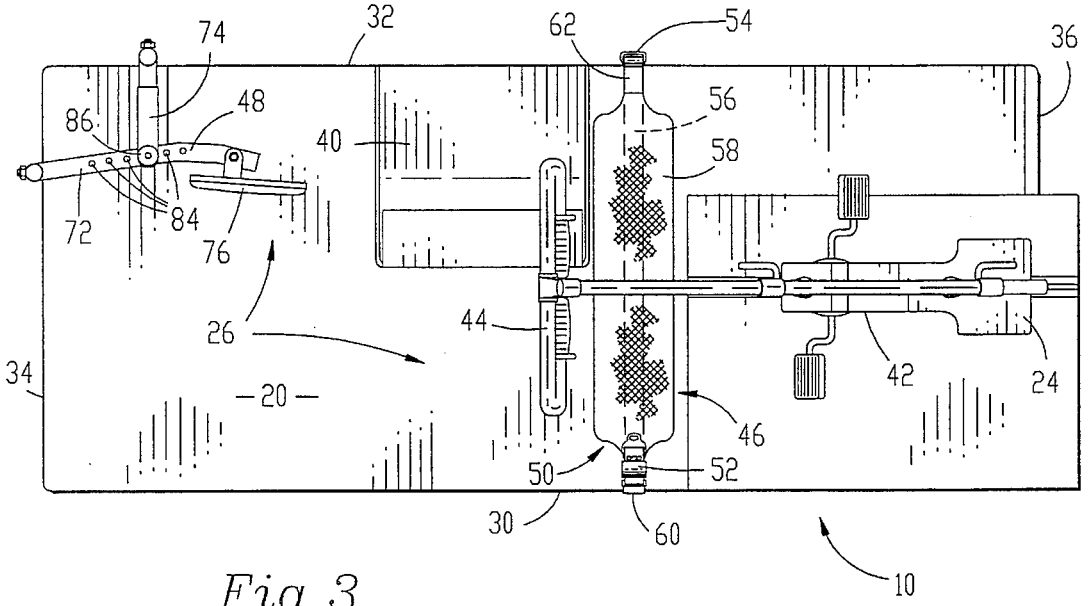
FIG. 3 is a top view of the patient support bed.

Support structure 26 is configured for supporting the patient on bed surface 20 while it is tilted. Support structure 26 broadly includes support sling 46 and shoulder support apparatus 48. As best illustrated in FIGS. 2 and 3, support sling 46 is adapted to circumferentially surround the patient's midsection and includes belt portion 50, retractable connecting belt 52, and releasable latching member 54.

Belt portion 50 is constructed of flexible fabric material and includes a narrow longitudinally extending support belt 56 covered by a wide body-engaging sling surface 58. Narrow support belt 56 extends a length at least equal to the width of bed surface 20 and includes opposed belt ends 60 and 62. Belt end 60 is fixedly attached to bed side margin 30 and includes a retractable connecting belt 52 having a metal tongue member 64 attached thereto. Belt end 62 initially overlies bed side margin 32 but is not attached to the bed. Belt end 62 includes a releasable latching member 54 configured for receiving and releasably latching metal tongue 64. Releasable latching member 54 includes a conventional belt-adjusting buckle for adjusting the length of belt end 62 so that patients of varying size can be secured to bed surface 20.

Wide body-engaging sling surface 58 is constructed of flexible fabric material and covers the mid-section of narrow support belt 56. Body-engaging sling surface 58 presents a wide mid-portion with tapered ends which converge to a width equal to the width of narrow longitudinally extending support belt 56.

In use, support sling 46 is configured to prevent the patient from sliding from bed 10 when bed surface 20 is tilted by circumferentially engaging the patient's midsection. As illustrated in FIG. 2, before sonographic testing the patient positions himself on bed surface 20 so that he overlies wide sling surface 58 of support sling 46. Belt ends 60 and 62 of narrow support belt are then wrapped around the stomach region of the patient. The belt ends are joined by engaging metal tongue member 64 with releasable latching member 54.

When bed surface 20 is tilted leftward by tilting mechanism 22, the patient's weight is transferred to wide sling surface 58 of support sling 46. Since support sling 46 is attached to bed surface 20 only at bed side margin 30, sling surface 58 circumferentially engages the patient's entire midsection. In this way, the patient is held securely in place and does not slide to the left margin of the bed.

Support sling 46 provides advantages not found in prior art seat-belt securement devices. For example, wide sling surface 58 does not hinder patient entry or exit from the bed surface and circumferentially surrounds the patient's entire midsection, resulting in a more comfortable and secure support arrangement. Moreover, the sling design supports the patient without pinching or limiting leg movement because the wide design of the belt and the circumferential engagement evenly supports the patient.

In preferred forms, patient support structure 26 also includes shoulder support apparatus 48. As best illustrated in FIG. 2, shoulder support apparatus 48 is adapted to prevent the patient from sliding from bed surface 20 by engaging the patient's shoulder while bed surface 20 is tilted. Shoulder support apparatus 48 broadly includes a pair of telescoping first and second support sections 68, 70, a pair of elongated intersecting first and second support arms 72, 74, and a shoulder support member 76.

First and second telescoping support section 68 and 70 include lower tubular sleeves 78, 80, and upper telescoping sections 82, 84. Lower tubular sleeves 78 and 80 are constructed of hollow tubular steel and are rigidly attached by conventional attachment means to bed front end rail 34 and right side margin 30, respectively. Upper telescoping sections 82 and 84 are constructed of hollow tubular steel and are telescopically received within fixed lower tubular sleeves 78 and 80.

Upper telescoping sections 82 and 84 are adapted to pivot within lower sleeves 78 and 80, thus enabling the rotation of support arms 72 and 74 as described below. Upper sections 82 and 84 are also adapted to telescope out from lower sections 78 and 80. In this way, the height of support arms 72 and 74 can be adjusted. A plurality of height-adjusting pins 83 are provided to position upper sections 82 and 84 within lower sections 78 and 80.

First and second elongated intersecting support arms 72 and 74 are rigidly attached to upper telescoping sections 82 and 84 and can be positioned as described above. First support arm 72 is coupled to telescoping section 82 and includes a generally flat shoulder support member 76 which engages the patient's shoulder while bed 10 is tilted. First support arm 72 also includes a plurality of spaced adjustment slots 85 along its longitudinal axis for facilitating positioning of support member 76 as described below.

Second support arm 74 is coupled to telescoping section 84 and intersects first support arm 72 near its midpoint. Second support arm 74 includes an adjustment pin 86 on one end thereof for engaging adjustment slots 85 of first support arm 72. Adjustment pin 86 can be selectively positioned in any one of adjustment slots 85 to adjust the position of the first and second support arms relative to one another. Since support arms 72 and 74 are pivotally coupled to first and second telescoping support section 68 and 70, they can be rotated and positioned so that shoulder support member 76 engages the shoulder region of patients of varying height and size.

In use, shoulder support apparatus 48 is configured to engage the patient's shoulder to prevent the patient from sliding from bed 10 when bed surface 20 is tilted. As illustrated in FIG. 2, the patient positions himself on bed surface 20 and is first secured by support sling 46 as described above. The positioning of support arms 72 and 74 are then adjusted so that support member 76 engages the patient's shoulder.

The components of patient-supporting bed 10 as described above provide an improved diagnostic patient support bed that facilitates effective sonographic testing while also supporting the patient on the bed in a secure and comfortable fashion. To begin sonographic testing, the patient first lies on bed surface 20 and is secured by support sling 46 and shoulder support apparatus 48. Bed surface 20 is then tilted by tilting mechanism 22 so that the patient's left side is tilted downward. The patient then performs an exercise test by operating exercise apparatus 24. After the patient has exercised for the proper time interval, filler section 40 is dropped to permit sonographic diagnosis of the patient. If a second opening on the opposite side of the bed is provided, it is also dropped to accommodate the legs or other aspect of a person performing the diagnosis.

The present invention provides numerous advantages. For example, the arrangement of the bed allows the cardiac sonography to be completed either during or immediately after the exercise test is concluded. In this way, the patient can exercise on the attached exercise apparatus and can be subsequently immediately examined. Additionally, the bed allows the patient to be examined while the bed is tilted, thus optimally positioning the heart within the chest cavity so that the sonography probes can obtain more sensitive and accurate results. Since the bed can be tilted to shift the patient's heart, the patient can be placed in the optimum position while exercising, thus eliminating the time needed to position the patient after exercise. Finally, the patient-supporting apparatus supports the patient on the bed in a secure and comfortable fashion while the bed is tilted.

Having thus described the preferred embodiments of the present invention, the following is claimed and desired to be secured by Letters Patent:

1. A diagnostic patient support bed, comprising:

an elongated, generally horizontally disposed bed presenting an uppermost bed surface for supporting a patient, a pair of elongated, laterally spaced apart first and second side margins, and a pair of axially spaced, transversely extending end margins;

tilting means for tilting said bed so that said first side margin is at a higher elevation than said second side margin; and a support member for supporting the patient on the tilted bed, said support member including shoulder-engaging means for engaging and supporting the patient's shoulder while said bed is tilted said support member including a pair of tubular first and second telescoping sections and a pair of elongated, intersecting first and second support arms pivotally coupled to said first and second telescoping sections, said first support arm including structure defining a plurality of spaced adjustment slots along its longitudinal axis said second support arm including an adjustment pin on one end thereof for engaging said adjustment slots, wherein said adjustment pin can be selectively positioned in any one of said adjustment slots to adjust the position of said first and second support arms.

2. The diagnostic patient support bed of claim 1, said first support arm including a shoulder support member coupled to one end thereof for engaging the patient's shoulder while said bed is tilted.

3. The diagnostic patient support bed of claim 1, said first and second telescopic sections including lower fixed tubular sleeves rigidly attached to said bed and upper telescoping sections concentrically received within said fixed tubular sleeves, said upper telescoping sections adapted to shift along a vertical axis for adjusting the height of said first and second support arms relative to said horizontal bed.

4. A diagnostic patient support bed, comprising:

an elongated, generally horizontally disposed bed presenting an uppermost bed surface, a pair of elongated, laterally spaced apart first and second side margins, and a pair of axially spaced, transversely extending end margins;

tilting means for tilting said bed so that said first side margin is at a higher elevation than said second side margin; and structure defining a first opening in said bed surface and respectively adjacent said first side margin, said first opening being located and sized for permitting sonographic diagnosis of a patient lying on said bed surface;

a first bed filler section sized to substantially fill said first opening; and support means for supporting the patient on the tilted bed, said support means including a flexible patient support sling adapted to circumferentially surround the patient's midsection, said sling presenting first and second belt ends, wherein said first belt end is fixedly attached to said bed first side margin and includes a retractable belt attached thereto, and said second belt end initially overlies said bed second side margin, wherein said first and second ends are adapted to wrap around the patient's midsection so that said support sling engages the patient's entire midsection, and an adjustable shoulder support apparatus adapted to engage the patient's shoulder while said bed is tilted.

5. The support bed of claim 4 further including an exercise apparatus coupled with said bed.

* * * * *